US010910137B2

(12) United States Patent
Bürssner et al.

(10) Patent No.: US 10,910,137 B2
(45) Date of Patent: Feb. 2, 2021

(54) ELECTROMAGNETIC POSITIONING SYSTEM AND OPERATING METHOD

(71) Applicant: ETO MAGNETIC GMBH, Stockach (DE)

(72) Inventors: Jörg Bürssner, Engen (DE); Peter Vincon, Stockach (DE)

(73) Assignee: ETO MAGNETIC GMBH, Stockach (DE)

( * ) Notice: Subject to any disclaimer, the term of this patent is extended or adjusted under 35 U.S.C. 154(b) by 133 days.

(21) Appl. No.: 16/337,024

(22) PCT Filed: Sep. 6, 2017

(86) PCT No.: PCT/EP2017/072323

§ 371 (c)(1),
(2) Date: Mar. 27, 2019

(87) PCT Pub. No.: WO2018/059890

PCT Pub. Date: Apr. 5, 2018

(65) Prior Publication Data

US 2020/0032681 A1 Jan. 30, 2020

(30) Foreign Application Priority Data

Sep. 27, 2016 (DE) ..... 10 2016 118 254

(51) Int. Cl.
*H01F 7/06* (2006.01)
*H01F 7/08* (2006.01)
(Continued)

(52) U.S. Cl.
CPC ..... *H01F 7/064* (2013.01); *H01F 7/081* (2013.01); *H01F 7/1646* (2013.01);
(Continued)

(58) Field of Classification Search
CPC ..... H01F 7/064; H01F 7/1646; H01F 7/081; H01F 2007/1669; H01F 2007/1692; H01F 7/1872; H01F 2007/1684
See application file for complete search history.

(56) References Cited

U.S. PATENT DOCUMENTS 5,203,172 A * 4/1993 Simpson ..... F15B 11/042 60/545
5,818,680 A * 10/1998 Schmitz ..... H01F 7/1646 361/160
(Continued)

FOREIGN PATENT DOCUMENTS

DE 10141764 A1 6/2002
DE 10310448 A1 9/2003
(Continued)

OTHER PUBLICATIONS

International search report for patent application No. PCT/EP20171072323 dated Nov. 30, 2017.
(Continued)

*Primary Examiner* — Mohamad A Musleh
(74) *Attorney, Agent, or Firm* — Bachman & LaPointe, PC

(57) ABSTRACT

An electromagnetic positioning system (1), including a valve train adjustment system for combustion engines, including a bistable electromagnetic positioning device (2) having a positioning element (3) for interacting with a positioning partner, the positioning element being adjustable between a retracted position (E) and an extended position (A) along an axis of adjustment (A) and having permanent magnet means (5) at least in sections.

19 Claims, 1 Drawing Sheet

(51) Int. Cl.
*H01F 7/16* (2006.01)
*H01F 7/18* (2006.01)

(52) U.S. Cl.
CPC .... *H01F 7/1872* (2013.01); *H01F 2007/1669* (2013.01); *H01F 2007/1684* (2013.01); *H01F 2007/1692* (2013.01)

(56) References Cited

U.S. PATENT DOCUMENTS

| | | | |
|---|---|---|---|
| 2003/0098686 | A1 | 5/2003 | Mednikov et al. |
| 2012/0306295 | A1 | 12/2012 | Kirstein |
| 2020/0032681 | A1 | 1/2020 | Bürssner et al. |

FOREIGN PATENT DOCUMENTS

| | | | |
|---|---|---|---|
| DE | 102004030779 | A1 | 1/2006 |
| DE | 10240774 | B4 | 5/2011 |
| DE | 102011081893 | B3 | 11/2012 |

OTHER PUBLICATIONS

German search report for patent application No. 10 2016 118 254.0 dated Aug. 9, 2017.

* cited by examiner

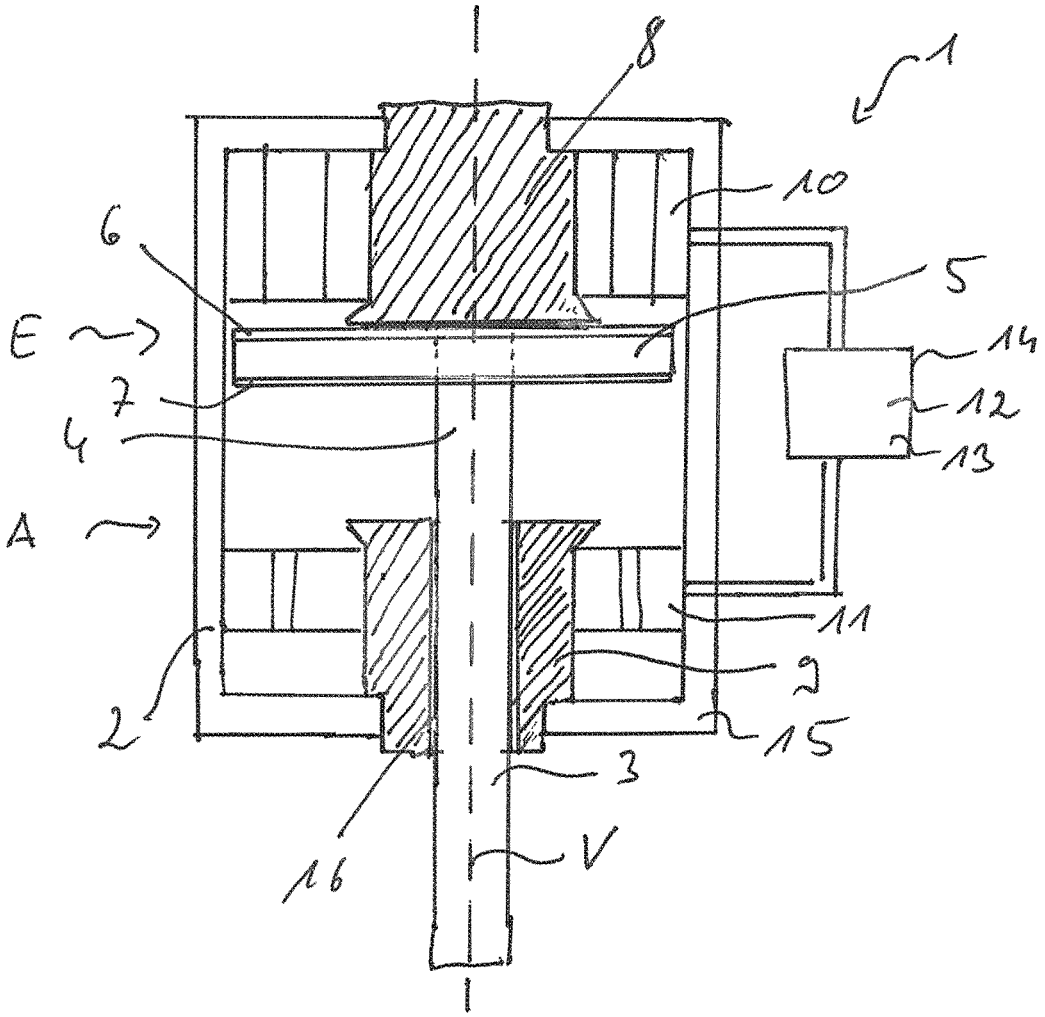
1
8
10
6
5
E
14
7
12
4
13
A
11
2
9
15
3
16
V

ELECTROMAGNETIC POSITIONING SYSTEM AND OPERATING METHOD

BACKGROUND OF THE INVENTION

The invention relates to an electromagnetic positioning system, in particular a valve train adjustment system for combustion engines, preferably in motor vehicles, comprising a bistable electromagnetic positioning device having a positioning element for interacting with a positioning partner, in particular with a cam follower, said positioning element being adjustable between a retracted position and an extended position along an axis of adjustment and having, in particular carrying, permanent magnet means at least in sections, the permanent magnet means being adjustable between axially spaced first and second core parts by adjustment of the positioning element along the axis of adjustment and adhering, in particular sticking, to the first core part with a permanent-magnetic holding force when the positioning element is in the retracted position and adhering to the second core part with a permanent-magnetic holding force when the positioning element is in the extended position, and the positioning device having first and second coils which can be controlled via control means, and the control means being configured to control the first and second coils in such a manner that, in a first operating mode for adjusting the positioning element from the retracted position into the extended position, the first coil responds to an electrical control signal of the control means by generating a counterforce which counteracts the holding force of the permanent magnet means, repels the permanent magnet means and detaches them from the first core part, and in a second operating mode for adjusting the positioning element from the extended position into the retracted position, the second coil responds to an electrical control signal of the control means by generating a counterforce which counteracts the holding force of the permanent magnet means, repels the permanent magnet means and detaches them from the second core part. Preferably, the first and second core parts serve as axial stops for the positioning element, which will be in contact with the respective core part when in the adjusted end positions. Preferably, the permanent magnet means are enclosed between two axially spaced pole disks, which will be in direct contact with the respective core part when in the end positions. The pole disks serve in particular to mechanically protect the usually brittle permanent magnet means when the positioning element comes to an axial stop. The permanent magnet means are preferably magnetized in the axial direction.

Electromagnetic positioning systems of this kind are used for cam shaft adjustment in particular in cases where the rotation of the cam shaft does not automatically return the positioning element from the extended position into the retracted position after cam shaft adjustment is completed. In cam adjustment systems of this kind, the positioning element has to be actively returned to the retracted position by means of the second coil. In a generic positioning system of this kind, the adjustment movement of the positioning element is monitored by a Hall sensor assigned to said positioning element and disposed in an area between the coils.

Aside from the electromagnetic positioning systems explained above, cam shaft adjustment systems such as the one described in the applicant's DE 102 40 774 B4 are known, whose electromagnetic positioning device comprises only a single coil by means of which the positioning element carrying permanent magnet means can be accelerated in the direction of its extended position. In positioning systems of this kind, the positioning element is returned by exerting a mechanical force on the positioning element via the cam shaft.

From DE 10 2004 030 779 A1, another electromagnetic positioning system having a single coil is known, which is non-generic. This coil serves as a sensor coil for detecting an induction signal which is generated by the mechanical returning of the positioning element from the extended position into the retracted position in order to be able to detect a malfunction in the valve lift adjustment back into the retracted position when an induction signal is absent. The known positioning device is not suitable for use in positioning tasks in which the positioning element is not automatically returned because the permanent magnet means of the positioning element will stay permanent-magnetically stuck in the extended position. Also, malfunctions in terms of the adjustment of the positioning element from the retracted position into the extended position cannot be detected by means of the known positioning systems.

In connection with motor vehicle valve trains of combustion engines, generic positioning systems are used for switching cam followers, such as articulated levers, for actuating gas exchange valves having different valve lifts and/or valve control times, or for their temporarily deactivation.

SUMMARY OF THE INVENTION

Based on the state of the art mentioned above, the object of the invention is to provide an improved positioning system, in particular for adjusting a cam follower as part of a valve train of a motor vehicle combustion engine, that comprises a bistable electromagnetic positioning device whose positioning element, which has permanent magnet means, is electromagnetically adjusted actively in two opposite axial directions by means of two coils and that is additionally characterized by extended diagnostic and monitoring options with regard to a proper adjustment movement of the positioning element. In a preferred embodiment, it should be possible to check adjustment movements of the adjusting element into both axial directions. The (additional) Hall sensor necessary in the state of the art should be omittable.

Furthermore, the object is to provide a correspondingly improved method of operation of an electromagnetic positioning system of this kind.

With regard to the electromagnetic positioning system, this object is attained by the features disclosed herein, i.e. by configuring a generic positioning system in such a manner that evaluating means for detecting an induction signal, in particular an electric voltage signal, which can be generated by the adjustment of the positioning element from the retracted position into the extended position along the axis of adjustment are assigned to the second coil, and that the control means are configured in such a manner that they de-energize the second coil in the first operating mode at least during a detection phase for detecting the induction signal, preferably during the entire first operating mode, and/or that evaluating means for detecting an induction signal, in particular an electric voltage signal, which can be generated by the adjustment of the positioning element from the extended position into the retracted position along the axis of adjustment are assigned to the first coil, and that the control means are configured in such a manner that they de-energize the first coil in the second operating mode at least during a detection phase for detecting the induction signal, preferably during the entire second operating mode. In a particularly preferred case, the evaluating means assigned to the second coil and to the first coil are shared evaluating means.

With regard to the method, the object is attained by the features disclosed herein.

Advantageous embodiments of the invention are indicated in the dependent claims. Any and all combinations of at least two of the features disclosed in the description, in the claims and/or in the FIGURES shall fall within the scope of the invention.

To avoid repetitions, features disclosed in accordance with the device shall be deemed to also be disclosed and claimable in accordance with the method. Likewise, features disclosed in accordance with the method shall be deemed to also be disclosed and claimable in accordance with the device.

The invention is based on the idea of controlling a generic electromagnetic positioning system and its bistable electromagnetic positioning device in such a manner that in the first operating mode (operating state), in which the positioning element is adjusted from the retracted position into the extended position by energizing the first coil, the second coil is used as a sensor coil. For this purpose, evaluating means by means of which an induction signal, in particular an electric voltage signal can be detected are assigned to the second coil, said induction signal being generated by electromagnetic induction when the positioning element, which has permanent magnet means, is adjusted from the retracted position into the extended position axially along the axis of adjustment by energizing the first coil. In order for the second coil to be able to fulfill the sensor coil function, it may further be envisaged for the second coil to be wired in such a manner that it is de-energized at least temporarily during the first operating mode, in particular during energization of the first coil. It is particularly preferred if this de-energized state is maintained for the entire duration of the first operating mode, i.e. from the start of the energization of the first coil until the positioning element has arrived in the extended position. During the de-energized period of the second coil in the first operating mode, the coil is thus unavailable for application of an electromagnetic force to the positioning element to support its adjustment movement. With the embodiment of the invention described above, it is possible for the first time to monitor a generic positioning system for whether the positioning element has been adjusted from the retracted position into the extended position (at all) and/or whether it has been adjusted timely within predetermined time limits.

Alternatively or preferably additionally to the embodiment variation or functionality of a positioning system according to the invention as described above, it is envisaged that monitoring of the process of adjustment from the extended position back into the retracted position is realized, in particular too, in that the first coil is tasked with the sensor coil function explained above in the second operating mode (operating state) by assigning evaluating means to the first coil so as to detect an induction signal, in particular an electromagnetic voltage signal, which is induced in the first coil by the positioning element when the energization of the second coil causes the positioning element to be accelerated or adjusted from the extended position in the direction of the retracted position. In order for the first coil to be able to fulfil its sensor coil functionality, it is envisaged according to the invention for the first coil to be de-energized by the control means at least temporarily during the second operating mode, in particular while the second coil is being energized. It is particularly preferred if the first coil is de-energized for the entire duration of the second operating mode, i.e. from the start of energization of the second coil until the positioning element has reached the retracted position.

When the first embodiment is realized, this means that the adjustment movement can be monitored during the first operating mode, i.e. with regard to the positioning element being adjusted from the retracted position into the extended position and, according to the second embodiment, in the opposite direction. As indicated before, an embodiment of the invention is particularly preferred in which both functionalities are realized together (one after the other). As explained in the beginning, the magnetically conductive positioning element has permanent magnet means, at least in sections, which are partially, preferably entirely, accommodated or disposed between the two core parts and adjustable between the core parts. Preferably, the permanent magnet means are disk-shaped and disposed on a tappet or tappet portion of the positioning element, which can be configured in one or multiple parts and, as will be explained later, passes through the second core part, preferably through only the second core part, so as to interact with a positioning partner, in particular a cam shaft follower, via an engagement portion, in particular an end portion, in particular in order to switch the positioning partner for, for example, actuation of at least one gas exchange valve having different valve lifts and/or different control times or for its temporary deactivation in connection with a valve train of a motor vehicle combustion engine.

The positioning system and the method according to the invention make it possible to omit the additional Hall sensor that has to be used in generic positioning systems for monitoring the positioning functionality.

There are different options regarding the specific evaluation or processing of an induction signal having been obtained, not obtained or obtained with delay. Evaluation and detection of the induction signal are useful in particular in the on-board diagnosis of engine control systems for monitoring valve lift adjustment including functional testing. In other words, the system according to the invention can be used to detect whether a requested or actuated adjustment movement of the positioning element axially in the direction of the extended position and/or axially in the direction of the retracted position has been successful, i.e. has taken place at all and/or in time, for example. In particular, the evaluating means and/or the control means know the actual or current position of the positioning element and can take it into account accordingly.

In an embodiment of the invention, it is advantageously envisaged for the evaluating means to respond to the absence of an induction signal and/or to a delayed induction signal by outputting a corresponding error signal, which characterizes an adjustment movement not having taken place or being delayed, and/or the evaluating means store corresponding error information. Additionally or alternatively, the evaluating means can be configured to respond to a received induction signal, in particular to an induction signal received in time, by outputting a corresponding acknowledgement signal and/or by storing corresponding acknowledgement information.

An embodiment in which the control means are configured to respond to the absence of an induction signal by outputting a new control signal to the first or second coil so as to adjust the positioning element into the desired axial direction or to control it to move in that direction once more after the adjustment movement has not taken place is conceivable, as well.

With regard to the design of the positioning device of the positioning system according to the invention, it is preferred, in particular with a view to cam follower switching tasks, for the positioning element to be disposed so as to have a tappet portion axially passing through the second core part. Preferably, a corresponding passage opening, in particular a passage drill hole, is provided in the second core part for this purpose. It is particularly advantageous if the positioning element axially passes through the second core part only and not through the first core part, which will preferably not have an axial passage opening in that case. A positioning device of this kind is characterized in that the positioning element passes through a housing of the positioning device at one end only.

It is particularly advantageous if a positioning partner, in particular a cam follower, is assigned to the positioning element in the system, said positioning partner being characterized in that it does not or cannot exert any mechanical restoring force, or at least no sufficient mechanical restoring force, for adjusting the positioning element from the extended position into the retracted position.

For valve train adjustment, in particular, it is advantageous if, in particular by providing a greater number of windings, the first coil is dimensioned to have more power than the second coil because the adjustment movement from the retracted position into the extended position in particular is time-critical, whereas the return can take more time.

With regard to the realization of the evaluating means, it has proven advantageous for the evaluating means, in particular of both embodiments explained above, to be configured for detecting an induction signal for adjustment in both if the axial directions and if the control means for the coils are formed by a shared logic unit, in particular an engine control unit.

Other advantages, features and details of the invention are apparent from the following description of a preferred embodiment and from the drawing.

BRIEF DESCRIPTION OF THE DRAWINGS

The only FIG. 1 of the drawing shows a highly schematized illustration of a preferred embodiment of an electromagnetic positioning system according to the invention.

DETAILED DESCRIPTION

Highly schematized, FIG. 1 depicts a preferred electromagnetic positioning system 1 configured according to the concept of the invention, in the example at hand a valve train adjustment system for combustion engines, in particular in motor vehicles. The electromagnetic positioning system 1 comprises a bistable electromagnetic positioning device 2 having a positioning element 3 which is adjustable along an axis of adjustment V between an illustrated retracted position E and an extended position A axially spaced therefrom. The positioning element 3 comprises a magnetically conductive tappet portion 4 which carries axially magnetized permanent magnet means 5 which are disposed axially between two magnetically conductive pole disks 6, 7, which are preferably metallic in the case at hand. In the illustrated retracted position E, a permanent-magnetic holding force generated by the permanent magnet means 5 keeps the positioning element 3 on a first core part 8.

The permanent magnet means 5 are located within a positioning device housing 15 which conducts the magnetic flux and via which the two magnetic flux circuits generated, preferably alternately, by the two coils 10, 11 are closed.

In the extended position A, which is axially spaced apart from the retracted position E, the positioning element 3 analogously adheres to a second core part 9 via a permanent-magnetic adhering force of the permanent magnet means 5, said second core part 9 being axially spaced apart from the first core part 8. At the same time, the core parts 8, 9 form axial stops for the positioning element 3 in that the pole disks 6, 7 are in contact with the respective core part 8, 9 in the corresponding position.

Furthermore, the positioning device 2 comprises a first coil 10, which radially surrounds the first core part 8 at the outside in the case at hand. Additionally, the positioning device 2 comprises a second coil 11, which is axially spaced apart and surrounds the second core part 9. Control means 12 and evaluating means 13, which will be explained later, are assigned to the two coils 10, 11, the control means 12 and the evaluating means 13 being formed by shared logic means 14. In a first operating mode, the control means 12 control the first coil 10 with a control signal (electrical energization), based on which the first coil 10 generates a magnetic field that counteracts the permanent-magnetic magnetic field. In other words, because of the control signal, the first coil 10 generates a counterforce to the permanent-magnetic holding or adhering force of the permanent magnet means 5, whereby the permanent magnet means 5 and the positioning element 3 are repelled from the first core part 8 in the direction of the extended position A, whereby the positioning element 3 moves into its extended position A, causing the tappet portion 4 to be axially moved further out of the positioning device housing 15 so as to interact with a positioning partner (not shown), preferably with a cam follower in the case at hand, in a manner known per se.

As can be seen, for this purpose, the positioning element 3 passes through a centric passage opening 16 in the second core part 9; the first core part 8 is closed, i.e. does not have a passage opening 16. During this first operating mode, the control means 12 de-energize the second coil 11, which has less power than the first coil 10. During said time, the second coil 11 has the function of a sensor coil in which an induction signal—an electric voltage in the case at hand—is generated by the adjustment movement from the retracted position E into the extended position A as explained above. This voltage is detected by the evaluating means 13 and processed, in particular in cooperation with the control means 12. In this way, it becomes possible to monitor the extending process or actuating process for actuating the positioning partner. This means that it can be detected whether the desired or prompted adjustment movement of the positioning element 3 actually takes place or has taken place.

In a second operating mode, the positioning element 3 located in the extended position A is returned into the illustrated retracted position E. For this purpose, the control means 12 control the second coil 11 with a control signal that exerts a repelling counterforce to the permanent-magnetic holding force onto the positioning element 3, whereby the latter is repelled from the second core part 9 in the direction toward the first core part 8. During this second operating mode, the control means 12 de-energize the first coil 10, which thus has the functionality of a sensor coil and detects an induction signal generated in the winding of the first coil 10 in the form of an electric voltage by the axial adjustment movement of the positioning element 3 with its permanent magnet means 5. This induction signal, which is an electric voltage signal in the case at hand, is detected by the evaluating means 13 and processed, preferably with the aid of the control means 12. In this way, it is possible to monitor an adjustment movement of the positioning element 3 from the extended position A back into the retracted position E.

REFERENCE SIGNS

1 electromagnetic positioning system
2 bistable electromagnetic positioning device
3 positioning element
4 tappet portion of the positioning element
5 permanent magnet means of the positioning element
6 pole disk of the positioning element
7 pole disk of the positioning element
8 first core part
9 second core part
10 first coil
11 second coil
12 control means
13 evaluating means
14 logic means
15 positioning device housing
16 passage opening
E retracted position
A extended position
V axis of adjustment

The invention claimed is:

1. An electromagnetic positioning system (1), in particular a valve train adjustment system for combustion engines, comprising a bistable electromagnetic positioning device (2) having a positioning element (3) for interacting with a positioning partner, said positioning element (3) being adjustable between a retracted position (E) and an extended position (A) along an axis of adjustment (V) and having permanent magnet means (5) at least in sections, the permanent magnet means (5) being adjustable between axially spaced first and second core parts (8, 9) by adjustment of the positioning element (3) along the axis of adjustment (V) and adhering to the first core part (8) with a permanent-magnetic holding force when the positioning element (3) is in the retracted position (E) and adhering to the second core part (9) with a permanent-magnetic holding force when the positioning element (3) is in the extended position (A), and the positioning device (2) having first and second coils which can be controlled via control means, and the control means being configured to control the first and second coil means (10, 11) in such a manner that, in a first operating mode for adjusting the positioning element (3) from the retracted position (E) into the extended position (A), the first coil (10) responds to an electrical control signal of the control means by generating a counterforce which counteracts the holding force of the permanent magnet means (5), repels the permanent magnet means (5) and detaches them from the first core part (8), and in a second operating mode for adjusting the positioning element (3) from the extended position (A) into the retracted position (E), the second coil (11) responds to an electrical control signal of the control means by generating a counterforce which counteracts the holding force of the permanent magnet means (5), repels the permanent magnet means (5) and detaches them from the second core part (9), wherein evaluating means (13) for detecting an induction signal which can be generated by adjustment of the positioning element (3) from the retracted position (E) into the extended position (A) along the axis of adjustment (V) are assigned to the second coil (11), and the control means are configured in such a manner that they de-energize the second coil (11) in the first operating mode at least during a detection phase for detecting the induction signal, and/or that evaluating means (13) for detecting an induction signal which can be generated by adjustment of the positioning element (3) from the extended position (A) into the retracted position (E) along the axis of adjustment (V) are assigned to the first coil (10), and the control means are configured in such a manner that they de-energize the first coil (10) in the second operating mode at least during a detection phase for detecting the induction signal.

2. The electromagnetic positioning system according to claim 1, wherein the evaluating means (13) are configured to respond to the absence of an induction signal and/or to a delayed induction signal by outputting an error signal and/or by storing error information and/or wherein the evaluating means are configured to respond to an induction signal by outputting an acknowledgement signal and/or by storing acknowledgement information.

3. The electromagnetic positioning system according to claim 1, wherein the control means (12) are configured to respond to the absence of an induction signal by outputting a new control signal to the first or second coil (10, 11).

4. The electromagnetic positioning system according to claim 1, wherein the positioning element (3) is disposed so as to have a tappet portion (4) axially passing through the second core part (9).

5. The electromagnetic positioning system according to claim 1, wherein the positioning element (3) is disposed so as to interact with a positioning partner which is configured and disposed so as to not exert any mechanical restoring force for adjusting the positioning element (3) from the extended position (A) into the retracted position (E).

6. The electromagnetic positioning system according to claim 1, wherein the first coil (10) is configured to generate a stronger magnetic field than the second coil (11) when both coils are energized to the same degree.

7. The electromagnetic positioning system according to claim 1, wherein the permanent magnet means (5) are at least partially disposed axially between the axially spaced coils (10, 11).

8. The electromagnetic positioning system according to claim 1, wherein the evaluating means (13) and the control means are formed by shared logic means.

9. A method for operating an electromagnetic positioning system (1) according to claim 1, wherein in the first operating mode, the control means supply a control signal to the first coil (10), which causes the positioning element (3) to be adjusted from the retracted position (E) into the extended position (A), and during said adjustment movement an induction signal generated in the second coil (11) by the adjustment of the positioning element (3) is detected by the evaluating means (13) assigned to the second coil (11), and that the control means de-energize the second coil (11) in the first operating mode at least during a detection phase for detecting the induction signal, and/or in the second operating mode, the control means supply a control signal to the second coil (11), which causes the positioning element (3) to be adjusted from the extended position (A) into the retracted position (E), and that during said adjustment movement an induction signal generated in the first coil (10) by the adjustment of the positioning element (3) is detected by the evaluating means (13) assigned to the first coil (10), and the control means de-energize the second coil (10) in the second operating mode at least during a detection phase for detecting the induction signal.

10. A use of an electromagnetic positioning system (1) according to claim 1 for adjusting a cam follower of a valve train of a combustion engine, in a motor vehicle.

11. The electromagnetic positioning system according to claim 1, wherein the evaluating means (13) are assigned to the second coil (11) and are configured in such a manner that they de-energize the second coil (11) during the entire first operating mode.

12. The electromagnetic positioning system according to claim 1, wherein the evaluating means (13) are assigned to the first coil (10) and are configured in such a manner that they de-energize the first coil (10) during the entire second operating mode.

13. The electromagnetic positioning system according to claim 2, wherein the evaluating means are configured to respond to a timely induction signal.

14. The electromagnetic positioning system according to claim 4, wherein the tappet portion (4) axially passes through only the second core part.

15. The electromagnetic positioning system according to claim 5, wherein the positioning partner is a cam follower.

16. The electromagnetic positioning system according to claim 7, wherein the permanent magnet means (5) are entirely disposed axially between, at an axial distance from, the axially spaced coils (10, 11).

17. The electromagnetic positioning system according to claim 8, wherein the shared logic means is an engine control unit.

18. The method according to claim 9, wherein the control means de-energize the second coil (11) during the entire first operating mode.

19. The method according to claim 9, wherein the control means de-energize the first coil (10) during the entire second operating mode.

* * * * *